United States Patent [19]

Ramer

[11] 4,002,354

[45] Jan. 11, 1977

[54] SKI BINDING

[76] Inventor: Paul C. Ramer, Rte. 4, P.O. Box 344, Golden, Colo. 80401

[22] Filed: Oct. 20, 1975

[21] Appl. No.: 623,623

Related U.S. Application Data

[63] Continuation-in-part of Ser. No. 552,970, Feb. 26, 1975, abandoned.

[52] U.S. Cl. ..... 280/614; 280/618; 280/636

[51] Int. Cl.[2] ..... A63C 9/086

[58] Field of Search ..... 280/614, 618, 620, 617, 280/633, 636, 611, 615

[56] References Cited

UNITED STATES PATENTS

| | | | |
|---|---|---|---|
| 2,491,485 | 12/1949 | Durham | 280/618 |
| 2,545,574 | 3/1951 | French | 280/618 |
| 2,649,306 | 8/1953 | Hilding | 280/614 |
| 2,950,118 | 8/1960 | Sharpe | 280/611 |
| 3,388,918 | 6/1968 | Hollenback | 280/614 |
| 3,625,535 | 12/1971 | Oehlman | 280/630 |
| 3,854,743 | 12/1974 | Hansen | 280/618 |

FOREIGN PATENTS OR APPLICATIONS

| | | | |
|---|---|---|---|
| 2,063,163 | 6/1972 | Germany | 280/614 |
| 1,808,712 | 6/1970 | Germany | 280/624 |
| 28,793 | 2/1898 | United Kingdom | 280/633 |

*Primary Examiner*—Robert R. Song
*Assistant Examiner*—David M. Mitchell

[57] ABSTRACT

A ski binding is provided for use both in alpine skiing and cross-country skiing and can be quickly converted between two different conditions for use in either type of skiing. A longitudinally extensible boot plate is selectably securable to the bottom of a ski boot and has laterally flexible spring bars pivotally and releasably connected to laterally extending pin members on a toe piece anchored to the ski so that the boot plate can move pivotally about an axis extending transversely of the ski. To prevent pivotal movement of the boot plate about the toe piece during alpine skiing, a heel piece is provided to hold the trailing end of the boot plate in closely adjacent relationship with the ski. The heel piece is selectively movable so as to release the trailing end of the boot plate for cross-country skiing and a heel lift plug can be incorporated into the heel piece to facilitate cross-country skiing. In addition, resilient means are provided on the heel piece which can be positioned beneath the trailing end of the boot plate to bias the boot plate upwardly to assist a skier in climbing uphill.

10 Claims, 14 Drawing Figures

SKI BINDING

This application is a continuation-in-part of my copending application Ser. No. 552,970 filed Feb. 26, 1975, now abandoned.

BACKGROUND OF THE INVENTION

The present invention relates generally to ski equipment and more particularly to a snow ski binding adapted for use in both alpine and cross-country skiing.

Ski bindings have evolved from a very crude form wherein a strap was used to secure the skier's boot to the ski to more sophisticated bindings which automatically release the skier from the ski when certain relative forces are applied to the skier or ski. These latter bindings have been referred to as release bindings and are intended to minimize the risk of injury to the skier. Release bindings have been directed toward alpine skiing and have not been concerned with crosscountry skiing which branch of skiing has been rapidly increasing in popularity. Bindings for cross-country skiing have not in the past varied materially and have all utilized some form of anchor for the toe of the skier's boot so that the heel of the skier's boot is free to lift as occurs in normal walking motions.

The recent increase of interest in cross-country skiing, however, has brought about a need for a binding which is readily convertible between use as an alpine skiing release binding and a cross-country binding. While several such bindings have been developed, none have been totally satisfactory for both applications.

OBJECTS OF THE INVENTION

It is an object of the present invention to provide a new and improved binding adapted for use both in alpine and cross-country skiing.

It is another object of the present invention to provide a new and improved binding for a ski which will reliably release the skier from the ski upon the application of certain applied forces to the ski or the skier.

It is another object of the present invention to provide a new and improved ski binding for use in cross-country skiing where the binding includes a lift for the heel of the skier's boot to facilitate up-hill climbing.

It is another object of the present invention to provide a new and improved ski binding which releases the skier's boot from the ski through the use of laterally flexible semi-rigid members which flex to release the boot from the ski on a predetermined applied force.

SUMMARY OF THE INVENTION

The ski binding of the present invention basically consists of a boot plate which is selectively securable to the bottom of a ski boot, and toe and heel pieces which are securely mountable on a ski to releasably retain the boot plate on the ski.

The boot plate includes on opposite sides thereof a pair of semi-rigid spring bars which protrude forwardly from a central body portion of the boot plate. The leading end of each spring bar has an inwardly opening recess therein which is adapted to releasably receive a laterally extending retension pin on the toe piece of the binding. Each pin on the toe piece protrudes into the recess in the associated spring bar and remains seated in the recess when the spring bar is in a neutral, unbiased condition. The pins thereby define an axis which extends transversely of the ski and about which the boot plate can pivot such as when the binding is in use for cross-country skiing. The boot plate further includes an extensible rear portion so that the interrelationship of the boot plate, toe and heel pieces can be easily regulated to facilitate proper mounting of the binding on a ski.

The heel piece includes a block member which has a beveled surface adapted to cooperate with a mating beveled surface on the trailing end of the boot plate to hold the rearward end of the boot plate immediately adjacent to the ski when the binding is being used for alpine skiing.

The retention pins which are seated in the recesses in the leading end of the spring bars have rounded heads which serve as cam surfaces to assist in biasing the spring bar outwardly away from the toe piece when a force is applied to the boot or ski. A predetermined force applied to the boot in various directions will cause at least one of the spring bar members to move relative to the ski which will cause the rounded head of one of the retention pins to bias the spring bar associated therewith outwardly causing it to be released from the pin so that the boot plate is released from the ski.

Accordingly, while the binding is ideally suited for cross-country skiing due to the pivotal connection of the boot to the ski near the toe of the boot, the binding also serves as a very reliable release binding when used for alpine skiing.

The heel piece has been designed so that it is movable between a position wherein it restrains the heel portion of the boot plate to retain the heel closely adjacent to the ski and a position wherein the heel of the boot plate is free to move in a vertical direction such as when the binding is used for crosscountry skiing. The heel piece includes a resilient member which can be positioned beneath the rearward end of the boot plate to bias the rearward end of the boot plate upwardly to assist a skier in climbing up hills by giving lift to the skier's heel. Further, a lift pin can be incorporated into the heel piece to facilitate skiing up unusually steep hills where possibly mechanical aids are used on the ski to grip the snow.

Other objects, advantages and capabilities of the present invention will become more apparent as the description proceeds taken in conjunction with the accompanying drawings.

DESCRIPTION OF THE PREFERRED EMBODIMENT

Figures 1, 2:
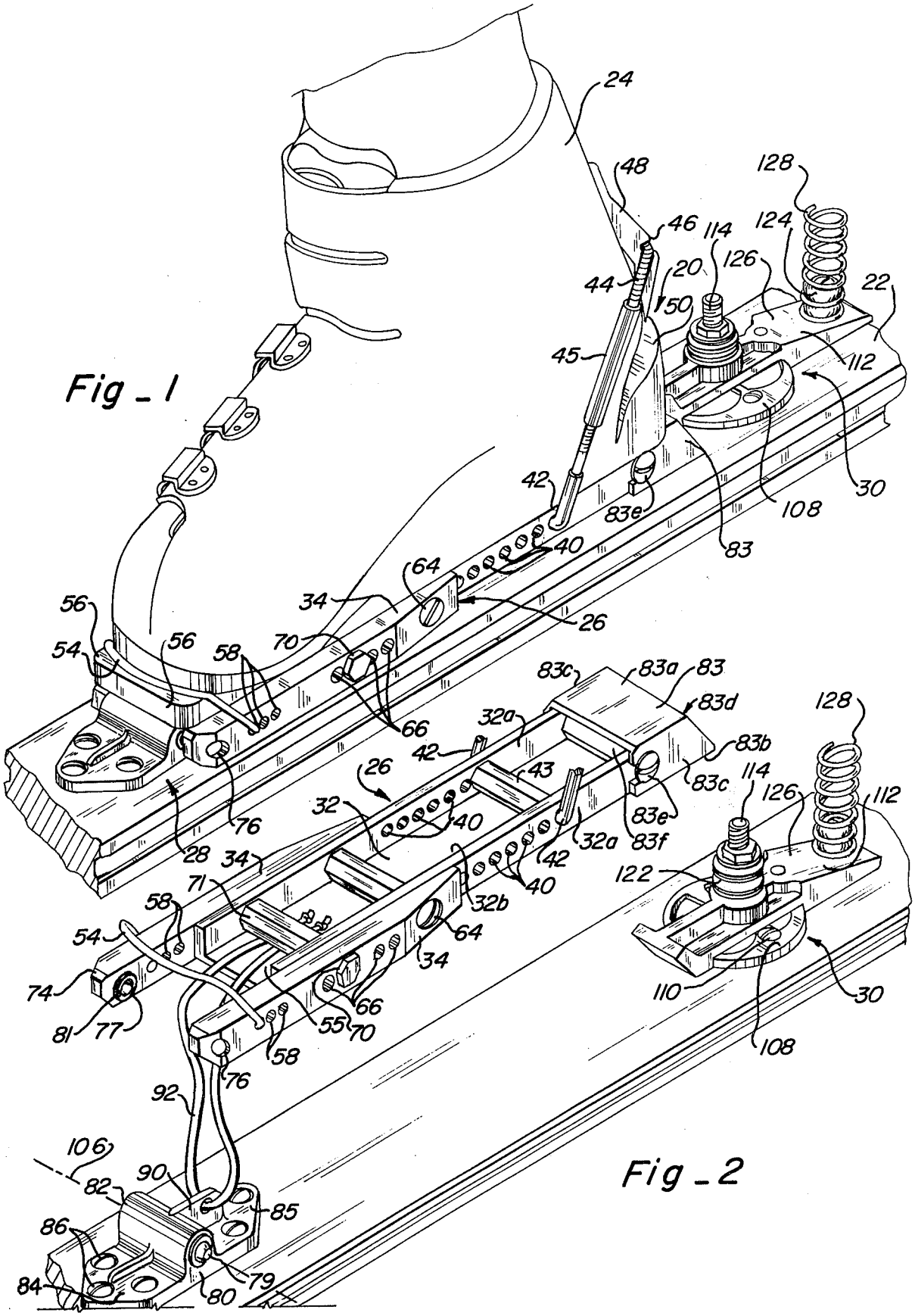
FIG. 1 is a fragmentary perspective view of a ski with the binding of the present invention mounted thereon and with a boot connected to the binding.
FIG. 2 is a fragmentary perspective view of a ski having a binding of the present invention mounted thereupon and with the boot plate portion of the binding removed from the toe and heel pieces.

Referring first to FIG. 1, the binding 20 of the present invention is shown mounted on a ski 22 with a ski boot 24 secured to the binding 20. The binding can be seen to consist of three basic component parts, namely (1) a boot plate 26, (2) a toe piece 28, and (3) a heel piece 30.

Figure 3:
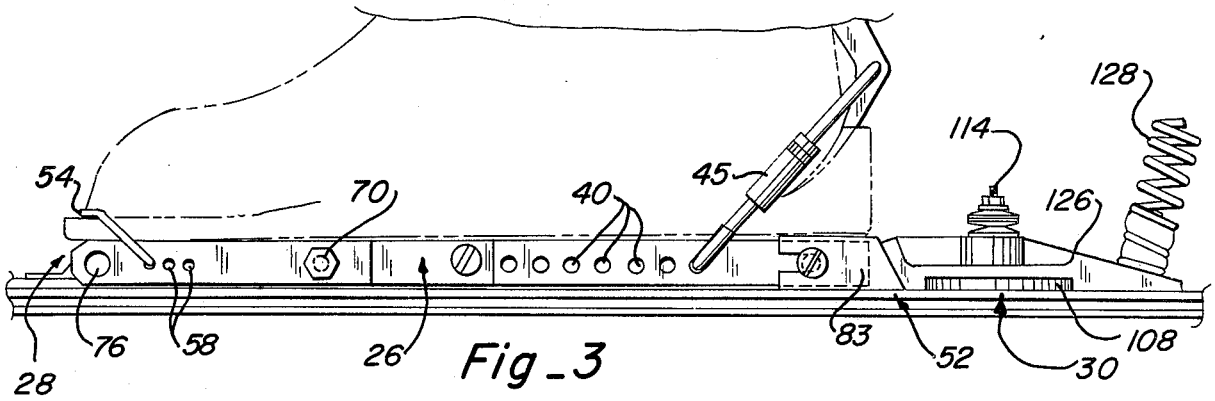
FIG. 3 is a fragmentary side elevation of the ski and binding as they are together in FIG. 1.

Referring first to the boot plate 26, which is best shown in FIG. 2, it can be seen to include a main body 32 and a pair of spring bar members 34 anchored to the sides of the body and protruding forwardly therefrom a preselected distance. The main body 32, which is preferably made of aluminum, polycarbonate, or the like, is channel shaped in configuration with the channel opening upwardly. The main body 32 has a set of aligned apertures 40 therethrough adapted to removably receive the inner ends 42 of a generally U-shaped bail member 44 which is adapted to retain the heel portion of a ski boot on the boot plate. The ends 42 of the bail are threadedly received in a barrel nut 43 extending between the sides 32a of the main body in alignment with a pair of aligned aperatures 40. The bail 44 is generally U-shaped in configuration and has extension sleeves 45 therein adapted to extend the length of the bail for various boot fittings. The U-shaped end 46 of the bail rotatably receives an over center latch 48 which is adapted to cooperate with the groove 50 typically provided on the heel of ski boots to bias the heel portion of the boot downwardly in tight engagement with the boot plate 26 as illustrated in FIGS. 1 and 3. The over center characteristic of the latch 48 assures that the heel of the boot will be securely retained against the trailing end of the boot plate until the latch 48 is released as by manual fingertip pressure applied to the top of the latch in a rearward direction.

A stiff U-shaped wire 54 is anchored to the spring bars 34 at a location immediately in front of the leading end 55 of the main body portion and this wire 54 is adapted to extend over and across the lip 56 provided on the toe of conventional ski boots to selectively retain the toe of the ski boot in secure tight relationship with the boot plate 26. A set of anchor holes 58 are provided in the leading end of the spring bars to give an added means for adjusting the cable 54 relative to the boot.

The spring bars 34 are mainly anchored to the body portion 32 of the boot plate by screw type fasteners 62 and 64 threaded into a barrel nut extending between the sides of the main body 32. A second set of apertures 66 or openings are provided through the spring bars 34 forwardly of their connection to the body portion by the fasteners 62 and 64, which openings are aligned with one pair of openings (not seen) provided through the sides 32*a* of the body portion 32 so that a movable securement bolt 70 or the like in cooperation with a barrel nut 71 can anchor the spring bar 34 to the body portion 32 at selected locations forwardly of the main connection. The purpose of this movable connection will become more clear later.

Figure 7:
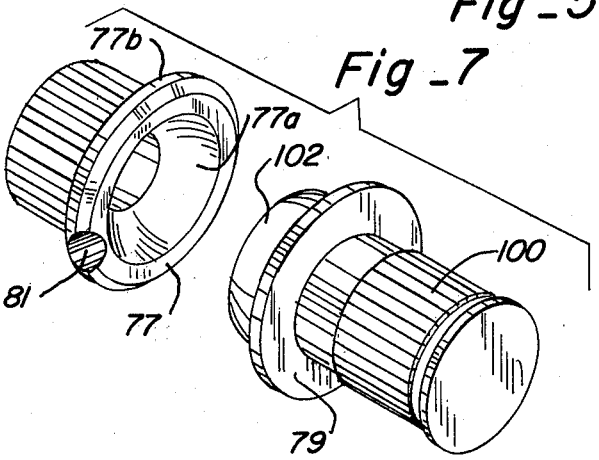
FIG. 7 is an enlarged perspective view of the pin and socket connectors between the top piece and boot plate of the binding of the present invention.

Near the forwardmost end 74 of each spring bar member 34, a transverse passage 76 is provided which is adapted to cooperate with the toe piece 28 in releasably connecting the forwardmost end of the boot plate to the ski. A female insert plug 77, FIGS. 2 and 7, is permanently positioned in the passage 76 of each spring bar and has a generally hemispherical socket 77*a* in its end to releasably receive a male plug 79 on the toe piece as will be described later. The edge 77*b* of the female plug 77 has a notch 81 formed therein which tapers forwardly and outwardly to assist in connecting the boot plate 26 to the toe piece 28 in a manner to be described hereinafter. Each spring bar 34 is made out of a semi-rigid material such as 7075 aluminum alloy and the forward ends of the spring bar members are adapted to flex laterally outwardly away from the body portion 32 upon the application of a preselected force which is determined partially by the strength of the material from which the spring bar is made, the location at which the movable fastener 70 connects the spring bars to the main body, the cross-sectional configuration of the spring bars, and the thickness of the spring bar members which can be seen to be greater on the leading end than on the trailing end in the embodiment disclosed. In other words, if the movable fasteners 70 are positioned in the rearwardmost of the openings 66, the distance from the fasteners to the leading end 74 of the spring bar, which is unattached to the body portion, is maximized so that the force necessary to flex the spring bar is minimized. Conversely, by positioning the movable fasteners in the forwardmost of the openings 66, the force required to flex the spring bar is maximized. Following the same theory, the positioning of the screw 70 in any intermediate opening between the forwardmost and rearwardmost ones will reflect on the force required to flex the spring bars outwardly to release them from the connections to the toe piece in a manner to be described hereinafter.

Figure 10:
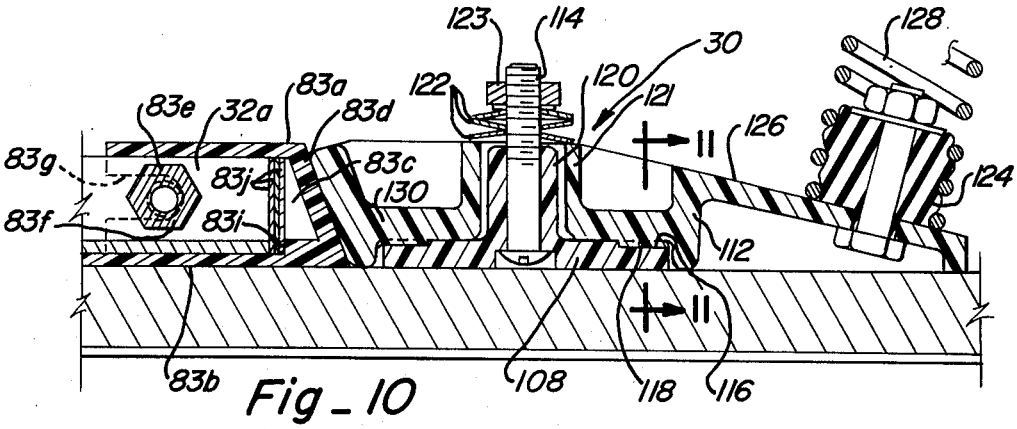
FIG. 10 is an enlarged section taken along line 10—10 of FIG. 5.

The boot plate has an end cap 83 slidably fit over the trailing end of the main body 32 so that the overall length of the boot plate can be regulated. The end cap 83 has top and bottom walls 83*a* and 83*b* respectively, side walls 83*c* and an upwardly and forwardly inclined end wall 83*d*. The front of the end cap is open to receive the trailing end of the main body. A lock bolt 83*e* passes transversely through the main body 32, a barrel nut 83*f* and forwardly opening slots 83*g* in the side walls 83*c*. The lock bolt has a nut 83*h* threaded on one end so that the bolt can be tightened to secure the end cap on the main body. Referring to FIG. 10, it will be seen that spacer plates 83*j* are positioned in the end cap between the trailing end of the main body and the end wall 83*d*. A shoulder 83*i* is formed in the bottom wall 83*b* so that the spacer plates 83*j* are maintained in an erect position against the trailing end of the main body. As can be appreciated, by adding additional spacer plates in the end cap, the overall length of the boot plate is increased and vice versa. This is an important feature of the invention since the interrelationship of the boot plate with the toe piece 28 and heel piece 30 is critical to the proper functioning of the binding and the provision of the easily extensible boot plate facilitates easy manipulation of this interrelationship. Prior to the present invention, the precise positioning of the toe and heel pieces on boot plate bindings was critical to the proper functioning of the binding so that when the toe and heel pieces were not precisely mounted on the ski, they would have to be remounted. Such remounting is, of course, alleviated with use of the present invention since the length of the boot plate itself can be regulated to compensate for any error in the mounting of the toe and heel pieces.

The toe piece 28 consists of a solid block 80 of material, such as aluminum, plastic or the like having a relatively thick center portion 82, thin forward and rearward portions 84 and 85 with openings (not seen) therethrough through which screw type fasteners 86 are passed to secure the toe piece 28 to the ski 22, and a rearwardly extending vertically oriented ear 90 having a lateral passage therethrough adapted to receive a safety cable 92. The safety cable is connected to the ear 90 and extends to the boot plate where it passes beneath the barrel nut 71 so that when a knot or the like is tied in the associated end of the cable 92, the cable will be retained between the lower wall **32*b* of the body and the barrel nut 71 so that the boot plate is loosely connected to the toe piece 28** whereby when the ski is released from the boot plate, it cannot get completely away from the skier but will be free from the skier to minimize risk of injury to the skier.

The toe piece has a transversely extending passage 96 through the relatively thick portion 82 thereof and the pair of laterally extending male plugs 79, FIG. 7, are seated therein. Each plug 79 has a serrated cylindrical body portion 100 which is received in the passage 96 and an enlarged generally hemisperical head 102 protruding laterally away from the side of the block 80. The pins 98 are formed to press into the passage 96 in a conventional manner for retention.

Figure 8:
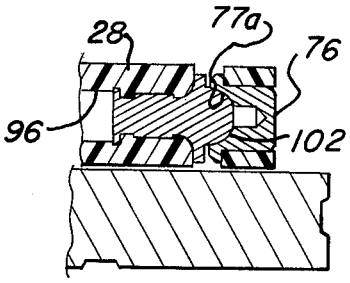
FIG. 8 is an enlarged section taken along line 8—8 of FIG. 5.
Figure 9:
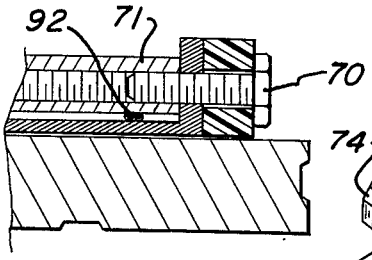
FIG. 9 is an enlarged section taken along line 9—9 of FIG. 5.

The rounded head 102 on each male plug 79 serves as a cam surface and is adapted to be releasably received in the socket **77*a* of the associated female plug 77 received in the leading end of each spring bar 34 to releasably and pivotally connect the forward end of the boot plate to the toe piece. When connecting the boot plate to the laterally extending plugs 79, one plug is seated in its associated female plug 77 and the boot plate is then rotated about that female plug until the rounded head on the other male plug 79 slides into the notch 81 in the other female plug causing the leading end of the associated spring bar to flex outwardly until the male plug snaps into the associated female plug where it also becomes releasably seated as best illustrated in FIG. 8. As will be appreciated, the male plugs 79 define an axis 106 which extends transversely of the ski 22 and about which the boot plate can pivot so long as the heel of the trailing end 52 of the boot plate is not confined. Movement of the spring bars 34 relative to the male plugs 79, other than the pivotal movement about the aforedefined transverse axis 106, will cause the rounded head of the male plugs 79 to cam the associated spring bar member 34 outwardly and if the force is great enough, the spring bar can be cammed outwardly until the associated male plug 79 pops out of the female plug 77 in the spring bar in which it was seated thereby releasing the boot plate from the toe piece. As mentioned previously, by positioning the movable fastener 70 in selected ones of the openings 66** in the spring bar members, the force required to snap the spring bar off the male plug can be selected.

The heel piece 30 can be seen to include a circular plate member 108 which is anchored to the ski 22 as by screw type fasteners 110 and an elongated pivotal block member 112 which is pivotally connected to the plate member by a bolt 114. Diametrically opposed linear grooves 116 are provided in the upper surface of the plate member and the plate member is disposed on the ski so that the grooves are positioned on a line extending along the central longitudinal axis of the ski. The grooves 116 cooperate with aligned linear beads 118 on the bottom surface of the heel piece in releasably holding the heel piece in a position in which it is aligned with the longitudinal axis of the ski as shown in FIGS. 1–5. As best seen in FIG. 10, the plate member 108 has a centrally located upstanding hub 120 with a vertical passage therethrough which receives the bolt 114. The block member 112 has an upstanding cylindrical sleeve 121 which loosely and pivotally receives the hub 120 so that the bolt 114 protrudes above the hub and sleeve. A plurality of disc springs 122 are received on the upwardly protruding end of the bolt 114 and a nut 123 is threaded thereon to compress the disc springs so that they bias the block 112 against the plate member 108 whereby the beads 118 on the block must overcome the bias of the disc springs 122 to be moved out of the grooves 116 in the plate member.

Figure 4:
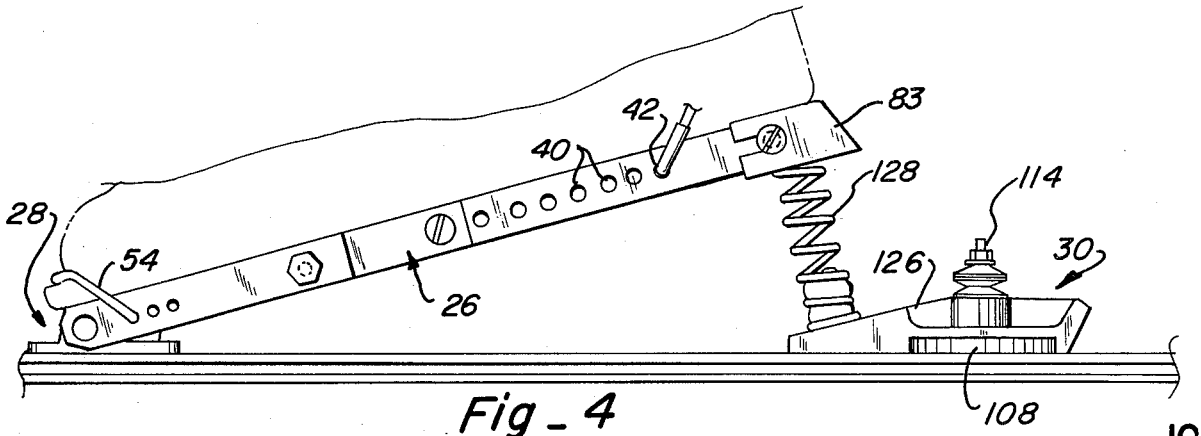
FIG. 4 is a fragmentary side elevation similar to FIG. 3 with the heel piece in a different position from that shown in FIGS. 1 and 3.
Figure 5:
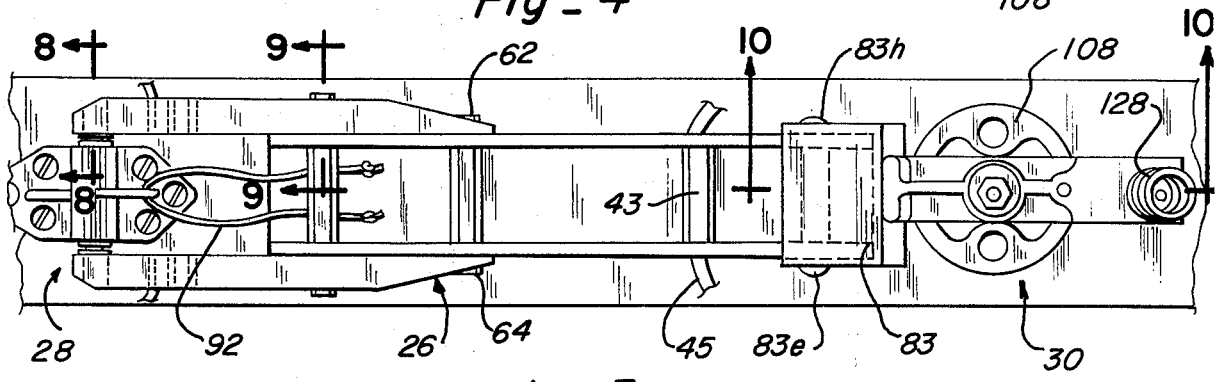
FIG. 5 is a fragmentary top plan view of a ski with the binding of the present invention mounted thereon.

The heel block 122 is elongated having a downwardly and rearwardly tapering upper surface of 126 on the rearward end when in its normal position of FIGS. 1–3. A compression type spring 128 is mounted on a generally cylindrical nub 124 on the tapering upper surface 126 for a purpose to be described later. The front end 130 of the block 112, when the block is oriented in the normal position of FIGS. 1–3, is formed to incline forwardly and upwardly so as to conform with the forwardly and upwardly inclined trailing end 36 of the boot plate 26 to hold the trailing end of the boot plate down adjacent the ski when the binding is in use for alpine skiing. When the heel block 112 is rotated 180° relative to the normal position shown in FIGS. 1 and 2, the spring 128 is underneath the trailing end of the boot plate and exerts an upward biasing force on the boot plate when compressed. As illustrated in FIG. 4, the heel block 112 can be positioned so as to extend laterally of the ski when it is neither desired to retain the trailing end of the boot plate adjacent the ski or to support the trailing end 52 with the spring 128.

When the ski is flexed an unusual amount, the effective distance between the toe and heel pieces is shortened causing the boot plate to be compressed between the toe and heel pieces. This would normally result in the boot plate being released from the toe piece or in placing an unusual strain on the heel piece. To alleviate this problem, the heel block 112 is loosely fitted over the hub 120 of the plate member, as previously mentioned, so as to permit limited vertical movement of the block relative to the ski.

Figure 6:
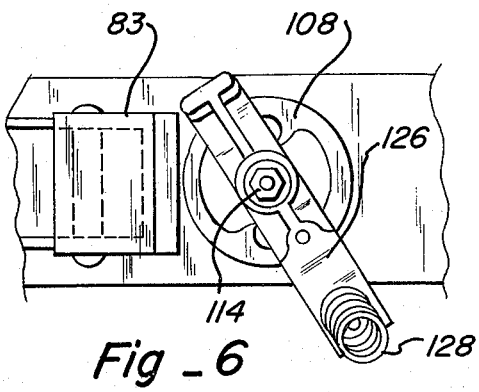
FIG. 6 is a fragmentary top plan view of a ski illustrating the heel piece of the binding of the present invention.
Figure 12:
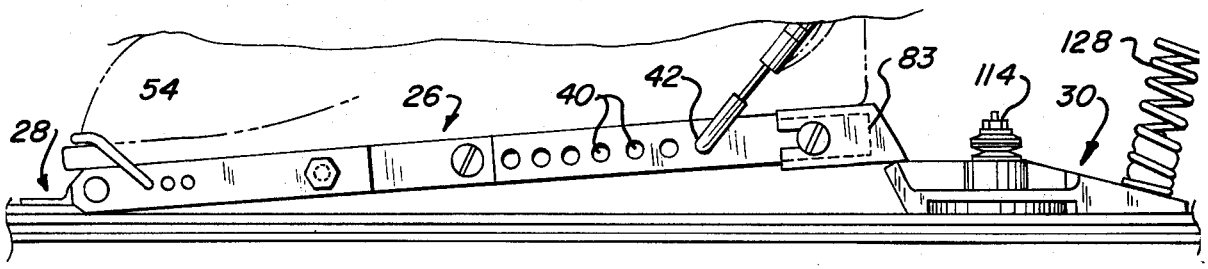
FIG. 12 is a fragmentary side elevational view similar to FIGS. 3 and 4 with the heel piece cooperating with the boot plate in another manner.
Figure 11:
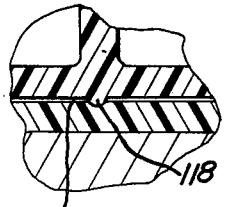
FIG. 11 is an enlarged section taken along line 11—11 of FIG. 10.

When the binding 20 is used for alpine skiing purposes, the leading end of the boot plate is connected to the laterally extending retention male plugs 79 and the heel piece is oriented in the normal position of FIGS. 1 and 2 so that the surface 130 on the forward end of the heel block 112 overlies the inclined surface 83d on the trailing end of the boot plate. This retains the boot plate in a parallel relationship with the ski 22 as is desired. If the boot is forced laterally of the ski as the result of a fall or the like by the skier, the boot plate is released from the toe piece 28 usually as a result of the inclined surfaces **83*d* and 130 at the trailing end of the boot plate and the forward end of the heel block respectively, cooperating in forcing the boot plate forwardly as the heel of the boot is pivoted either in a vertical or horizontal direction about the toe piece. Forward movement of the boot plate will cause at least one of the spring bar members 34 to be moved, other than pivotally about the axis 106, to cause a retention pin to force the spring bar out until it is released from the pin. Similarly, if the heel of the skier is lifted by an excessive force, the beveled surfaces on the trailing end of the boot plate and the forward end of the heel block will cam the boot plate forwardly so that both spring bars are cammed or forced outwardly by the retention pins to release the spring bars from the toe piece. It will, therefore, be appreciated that in alpine skiing, the skier is positively connected to the ski under normal skiing conditions, but if an excessive force is applied to the boot, the boot along with the boot plate will be separated from the ski with the exception of the loose cable connector 92, so that risk of injury to the skier is minimized When the binding is used for cross-country skiing purposes, the spring bars are connected to the retention pins on the toe piece and the heel block is oriented laterally as shown in FIG. 6, or with the leading end of the heel block under the boot plate as shown in FIG. 12, so that the heel of the boot plate is not confined and so that the boot and boot plate will pivot freely about the transverse axis 106 passing through the retention pins in the toe piece. When climbing up a hill, for example during cross-country skiing, the heel block is oriented as shown in FIG. 4, with the spring underlying the trailing end 52** of the boot plate so as to disengagingly elevate the heel of the boot relative to the ski whereby the skier's foot is oriented in a substantially horizontal position even though the ski may be inclined relative to horizontal as it lies on the upwardly inclined slope. This makes it easier for the skier to advance up the slope and the spring bias assists the skier by giving a lift to his heel with each sliding step without restricting the forward pivotal motion of the boot plate so that uphill skiing is not as difficult as with conventional cross-country bindings or conventional alpine bindings.

Figure 13:
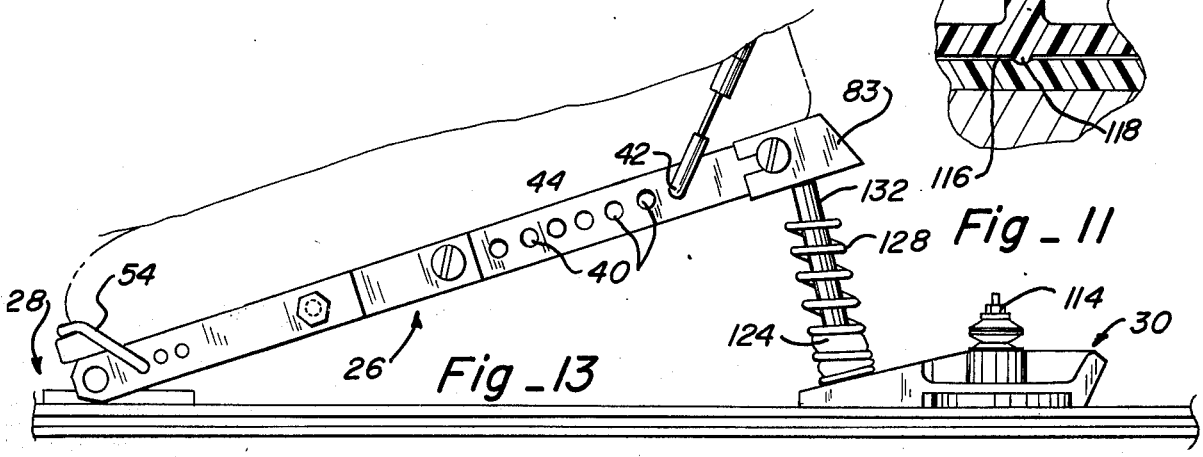
FIG. 13 is a fragmentary side elevational view similar to FIG. 4 illustrating the use of a lift pin in the binding.

When climbing unusually steep hills, for example when the skier may be using a mechanical aid such as an animal skin releasably affixed to the bottom of the ski to grip the snow, a rigid plug 132, FIG. 13, is inserted into the coil spring 28 so as to protrude above the spring and support the trailing end of the boot plate. When the boot plate is so supported, the skier's foot can be oriented substantially horizontally even though the ski is lying flat on the unusually steep hill.

Figure 14:
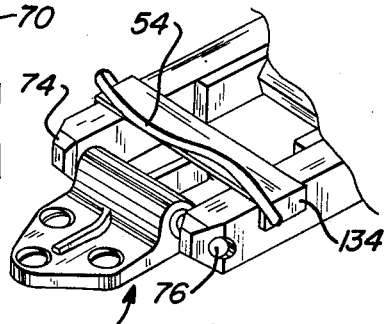
FIG. 14 if a fragmentary perspective view of the forward end of the binding of the present invention showing use of a clip to prevent release of the binding.

To prevent the boot plate from releasing from the toe piece, possibly accidentally during cross-country skiing, an inverted U-shaped clip 134, FIG. 14, is provided to fit beneath the toe of a boot and strattle the boot plate so as to lie along the outer surfaces of the spring bars to prevent lateral movement of the spring bars which, of course, prevents release of the boot plate from the toe piece. The clip 134 has grooves along opposite sides thereto to receive the toe wire 54 which helps to hold the clip in place. Of course, the clip is not used when the release characteristics of the binding are desired to be operable.

Although the present invention has been described with a certain degree of particularity, it is understood that the present disclosure has been made by way of example and that changes in details of structure may be made without departing from the spirit thereof.

What is claimed is:

1. A binding for releasably connecting a boot to a ski comprising in combination:

a toe piece mounted on said ski, laterally extending pin means having cam surfaces on opposite ends thereof, said pin means being operably connected to said toe piece, a boot plate releasably connectable to said boot having a body portion and semi-rigid elongated member means extending longitudinally of said ski, said elongated member means having recesses on forward ends thereof for releasably receiving said ends of the pin means, said elongated member means flexing laterally outwardly upon release from said pin means, and selectively movable anchor means on said boot plate for anchoring the elongated member means to the boot plate at selected locations along the length of the elongated member means, and a heel piece mounted on said ski for selectively holding the heel of the boot plate adjacent to the ski.

2. The ski binding of claim 1 wherein said boot plate is operably pivotally connected to said pin means such that when the heel of the boot is operably free of the heel piece, the boot can pivot about a transverse axis passing through said pin means.

3. The ski binding of claim 1 wherein said heel piece includes means to allow limited movement of the heel piece relative to the ski when the ski is flexed with the boot plate connected thereto.

4. A binding for releasably connecting a boot to a ski comprising in combination:

a toe piece mounted on said ski, retention means extending laterally of said ski operably connected to said toe piece, a boot plate releasably connectable to said boot having a body portion and semi-rigid elongated members extending longitudinally of said ski, said elongated members having connection means on forward ends thereof for releasable connection to said retention means, said forward ends being free to flex laterally outwardly for release from said retention means, and selectively movable anchor means on said boot plate for anchoring the elongated members to the boot plate at selected locations along the length of the elongated members, and a heel piece mounted on said ski for selectively holding the heel of the boot plate adjacent to the ski or for releasing the boot plate heel to allow the plate to pivot about a transverse axis at said retention means, said heel piece including a resilient member and means for selectively positioning said resilient member beneath the heel of the boot plate to bias the heel upwardly away from the ski.

5. The ski binding of claim 1 wherein said boot plate has an inclined trailing end, and wherein said heel piece consists of a block which is pivotally mounted upon the ski, said block having an incline on one end adapted to cooperate with the inclined trailing end of said boot plate to hold the trailing end of the boot plate in adjacent relationship with the ski, and wherein said resilient member is mounted on the opposite end of the block.

6. The ski binding of claim 5 wherein said inclined trailing end of the boot plate further cooperates with the incline on said heel piece in releasably holding the heel of the boot plate adjacent the ski until a predetermined force is applied to the heel of the boot plate which causes the incline on the heel piece and the inclined trailing end of the boot plate to cooperate in moving the boot plate forwardly along the ski.

7. A binding for releasably connecting a boot to a ski comprising in combination:

toe piece means for releasably and pivotally connecting the toe of a boot to the ski such that the boot can pivot about the toe thereof by lifting and lowering the heel of the boot, and selectively movable heel piece means operably engageable with the heel of the boot to hold the heel adjacent the ski and adapted to be moved to prevent the heel of the boot from returning to the ski to allow selected angular relationships to be maintained between the boot and the ski when said heel piece is positioned beneath the heel of the boot.

8. The binding of claim 7 wherein said heel piece means includes a resilient member adapted to bias the heel of the boot away from the ski when said heel piece means and said resilient member is positioned beneath the heel of the boot.

9. A binding for releasably connecting a boot to a ski comprising in combination:

a toe piece mounted on the ski, a heel piece mounted on the ski in spaced relationship from said toe piece, and a boot plate having means for releasably mounting the boot therein, said boot plate being releasably connectable to said toe piece and heel piece and including extention means for varying the length of the boot plate to facilitate establishment of a desired operative relationship between the boot plate, the toe piece and heel piece, said boot plate including a main body member and said extension means including an end cap slidably received on an end of said main body member, and further including spacer members removably positionable between said main body member and said end cap.

10. The binding of claim 9 further including tightenable means interconnecting the main body member and end cap to selectively retain a fixed relationship between the main body member and end cap.

* * * * *